US005205018A

United States Patent [19]

Leifeld et al.

[11] Patent Number: 5,205,018

[45] Date of Patent: Apr. 27, 1993

[54] APPARATUS FOR MAKING A LAP FROM TEXTILE FIBERS

[75] Inventors: Ferdinand Leifeld, Kempen, Fed. Rep. of Germany; Klaus Staats, Tega Cay, S.C.

[73] Assignee: Trützschler GmbH & Co. KG, Mönchengladbach, Fed. Rep. of Germany

[21] Appl. No.: 629,686

[22] Filed: Dec. 18, 1990

[30] Foreign Application Priority Data

Dec. 22, 1989 [DE] Fed. Rep. of Germany ..... 3942440

[51] Int. Cl.[5] ..... D01G 13/00

[52] U.S. Cl. ..... 19/145.5; 19/296; 19/66 R

[58] Field of Search ..... 19/0.27, 66 R, 66 CC, 19/144, 145, 200, 201, 204, 297, 65 R, 65 A, 145.5, 296, 302

[56] References Cited

U.S. PATENT DOCUMENTS

| | | | |
|---|---|---|---|
| 2,055,410 | 9/1936 | Hurst et al. | 19/296 |
| 3,645,814 | 2/1972 | Knoepfler et al. | 19/302 |
| 3,717,904 | 2/1973 | Bonner et al. | 19/66 R |
| 3,772,107 | 11/1973 | Gentile et al. | 19/302 |
| 3,802,030 | 4/1974 | Acree | 19/66 CC |
| 3,802,838 | 4/1974 | De La Serviere | 19/66 R |
| 3,834,869 | 9/1974 | Ancelle et al. | 19/66 R |
| 3,940,216 | 2/1976 | Hinckley | 19/302 |
| 4,243,446 | 1/1981 | Mathey | 19/66 R |
| 4,527,306 | 7/1985 | Thannheiser | 19/66 CC |
| 4,914,787 | 4/1990 | Leifeld et al. | 19/145 |
| 4,944,070 | 7/1990 | Girard et al. | 19/66 CC |

FOREIGN PATENT DOCUMENTS

| | | | |
|---|---|---|---|
| 3322560 | 1/1985 | Fed. Rep. of Germany . | |
| 3713590 | 10/1987 | Fed. Rep. of Germany . | |
| 3740616 | 6/1989 | Fed. Rep. of Germany | 19/145.5 |
| 1577775 | 8/1969 | France . | |
| 2518586 | 6/1983 | France | 19/200 |
| 4013951 | 4/1974 | Japan | 19/302 |
| 1423639 | 9/1988 | U.S.S.R. | 19/66 R |

OTHER PUBLICATIONS

Trützschler, "Flockenspeiser Exactafeed FBK 533 mit Elektronischer Steuerung Contifeed CF", tpi-Zeitschrift 1986, vol. 12, p. 1310.

Hendler et al "Vliesverfestigung durch Faserstoffverwirbelung-Norafin", Textiltechnik 38, 1988, pp. 430-434.

*Primary Examiner*—Andrew M. Falik
*Assistant Examiner*—Michael A. Neas
*Attorney, Agent, or Firm*—Spencer, Frank & Schneider

[57] ABSTRACT

An apparatus for making a fiber lap comprises the following combination: a plurality of serially arranged, vertically oriented hoppers charged with fiber tufts from above; removing device for removing the fiber tufts from the hoppers from below; a conveyor arranged to successively run past the hoppers and simultaneously receive fiber tufts therefrom whereby a multilayer fiber tuft mass is formed on the conveyor; a reinforcing device for stabilizing the multilayer fiber tuft mass and forming a fiber lap therefrom; and a wet treatment device.

6 Claims, 4 Drawing Sheets

8
49
47
K
48a
M
48a
45c
48a
46
45a
L
48b
48b
48b
45b 58
56
11
57
63
55
54
59
59a
60
10
12
53
50
51
52a
62a
61
62
61a
61b
52b

APPARATUS FOR MAKING A LAP FROM TEXTILE FIBERS

CROSS REFERENCE TO RELATED APPLICATION

This application claims the priority of Federal Republic of Germany Application No. P 39 42 440.5 filed Dec. 22nd, 1989.

BACKGROUND OF THE INVENTION

This invention relates to a method and an apparatus for making a lap from textile fibers such as cotton.

According to a known method, the fiber material passes through a fiber opening and charging device, a width distribution device having a discharge opening and a lap forming device which has four opening units each having a clothed drum and a working/reverser roll pair. The processing of unlike fiber types is not contemplated. Further, in the known process no cleaning of the fiber material is feasible so that only high quality fiber material may be processed which is economically disadvantageous.

SUMMARY OF THE INVENTION

It is an object of the invention to provide an improved method and apparatus of the above-outlined type which makes possible the processing of different, unlike types of fiber material, such as batches of raw cotton, cotton waste and the like.

This object and others to become apparent as the specification progresses, are accomplished by the invention, according to which, briefly stated, the method of making a fiber lap comprises the following sequential steps: charging a plurality of serially arranged, vertically oriented hoppers with fiber tufts from above; removing the fiber tufts from the hoppers from below; simultaneously depositing the fiber tufts on a conveyor arranged to successively run past the hoppers whereby a multilayer fiber tuft mass is formed on the conveyor; reinforcing the multilayer fiber tuft mass for forming a fiber lap therefrom; and exposing the fiber lap to a wet treatment.

By mixing the textile fibers, it is feasible to process fibers of different type, for example, raw wool taken from different sources, waste fibers and useful waste fibers (such as torn web portions and the like). According to the invention the fiber material of different types is superposed in layers and reinforced to obtain a fiber lap. A fiber lap stabilized in this manner subsequently passes through a wetting station which improves the fiber material.

Expediently, different types of fiber material are placed in individual hoppers. In this manner, different types of fiber such as different types of cotton, soiled waste fiber, clean and useful waste fiber may be processed. Expediently, the superimposed layers of fiber are needled to one another. Expediently, the fiber mass is bleached whereby soiled parts in the cotton waste such as trash, stem fragments and the like are essentially or entirely eliminated thus qualitatively significantly improving the fiber material. Preferably, the fiber lap is, subsequent to the wet handling, advanced to a drying apparatus and thereafter to an opening device which separates the fiber mass into fiber tufts. Preferably, the fiber tufts are advanced to a fiber lap processing machine such as a rollercard unit.

In an apparatus according to the invention there are provided a plurality of serially arranged hoppers such as feed chutes, fill chambers or the like (mixers) which may be charged with fiber material from above by means of one or more charging devices. Underneath the hoppers there is provided a common fiber conveyor on which the fiber material is deposited in superposed layers. Downstream of the conveyor a device for the mechanical stabilization of the superposed layers is arranged, followed by a wet treating device.

DESCRIPTION OF THE PREFERRED EMBODIMENTS

Figure 1:
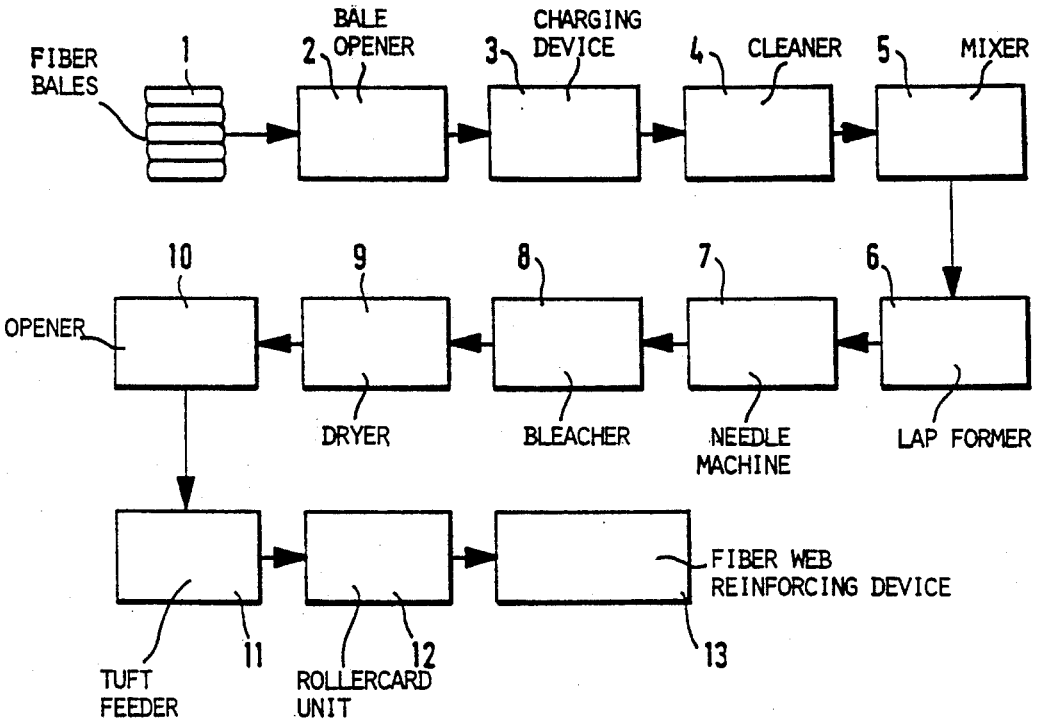
FIG. 1 is a symbolic illustration of a fiber processing line, incorporating a preferred embodiment of the invention.

Turning to FIG. 1, a bale opener 2 removes fiber tufts from fiber bales 1. The bale opener 2 may be, for example, a BLENDOMAT BDT model, manufactured by Trützschler GmbH & Co. KG, Mönchengladbach, Federal Republic of Germany. From the bale opener 2 the fiber tufts are admitted to a charging device 3, such as a feed chute and are advanced thereby to a cleaner 4 which may be, for example, an RST model, manufactured by Trützschler GmbH & Co. KG. The cleaner 4 removes impurities such as trash, sand, leaf and stem fragments and the like from the fiber tufts which are then introduced into the fill chambers of a mixer 5 which may be, for example, an MPM model, manufactured by Trützschler GmbH & Co. KG.

From the mixer 5 the fiber tufts are introduced into a lap forming device 6 which may be, for example, an FMB mixer belt manufactured by Trützschler GmbH & Co. KG, and on which the fiber is deposited in several layers. The multi-layer fiber tuft mass is advanced to a needle machine 7 which may be an NL 9/S model, manufactured by Fehrer and in which the fiber lap is mechanically reinforced (stabilized). Thereafter the fiber lap is passed through a wet treatment station such as a bleaching machine 8 and a dryer 9.

From the dryer 9 the fiber lap is admitted to an opener 10 which may be an SFO model, manufactured by Trützschler GmbH & Co. KG. The opener 10 breaks up the fiber lap into fiber tufts which are, for example, pneumatically advanced in a tubular conduit into a fiber tuft feeder 11 which may be, for example, an EXACTAFEED FBK model, manufactured by Trützschler GmbH & Co. KG. The tuft feeder 11 forms a fiber lap which is introduced into a rollercard unit 12 which makes a fiber web that is thermally stabilized in a lap reinforcing device 13.

Figure 2:
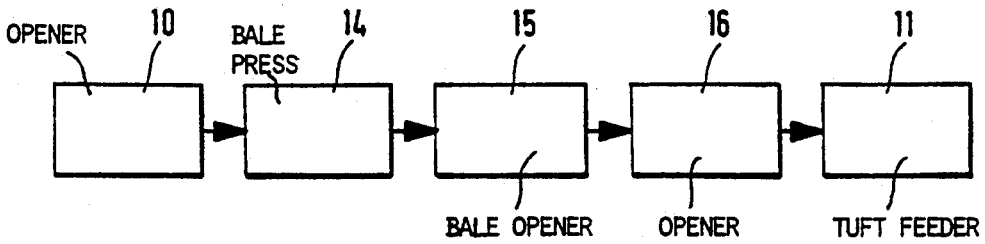
FIG. 2 is an illustration similar to FIG. 1, showing a variant of the processing line of FIG. 1.

FIG. 2 shows an expanded version of the processing line of FIG. 1. Thus, the opener 10 is followed by a bale press 14 which presses the fiber tufts into fiber bales which, in turn, is opened by a bale opener 15 (which also may be a BLENDOMAT BDT model) to again produce fiber tufts. Then the material is opened to produce finer fiber tufts in an opener 16 (such as an SFO model) from where then the material is introduced into the tuft feeder 11.

Figure 3:
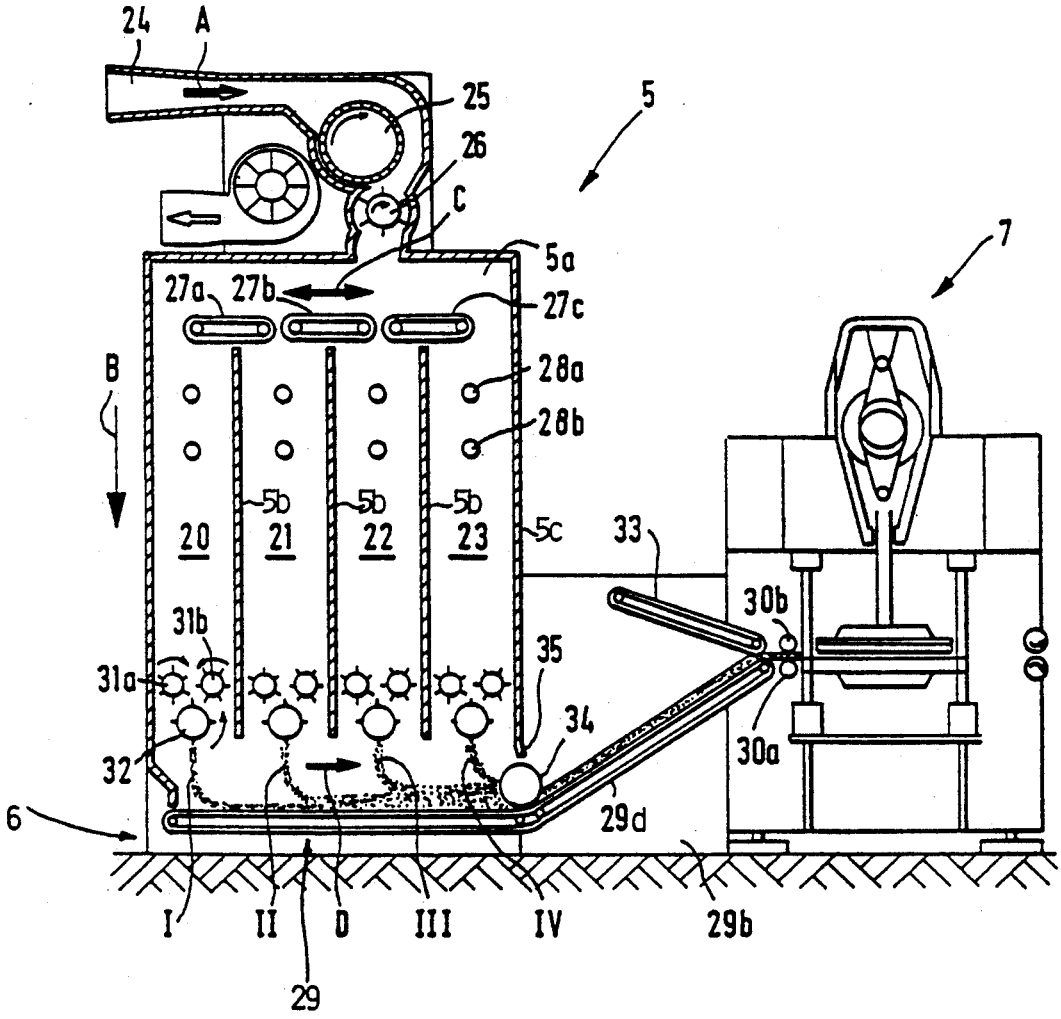
FIG. 3 is a schematic side elevational view of component machines of the embodiments according to FIGS. 1 or 2.

FIG. 3 shows the mixer 5 which has a series of four fill chambers (hoppers) 20, 21, 22 and 23, communicating with an overhead duct 24 through which fiber tufts are conveyed pneumatically in the direction of the arrow A. Between the duct 24 and the upper space 5*a* of the mixer 5 a screening drum 25 is arranged which separates the fiber tufts from the conveying air stream by causing the latter to enter the inside of the drum, while the fiber tufts remain at the outside of the drum. Immediately downstream of the screen drum 25 a dosing wheel 26 is arranged. Above the chamber separating walls 5*b*, in the upper mixer space 5*a* there are situated conveyor belts 27*a*, 27*b* and 27*c* which may be driven in either direction as shown by the double-headed arrow C and which distribute the fiber tufts into the mixer chambers 20–23. Each mixer chamber 20–23 has, in a wall zone, two photocells 28*a*, 28*b* which protect both against excessive filling and idle runs. The momentary conveying direction of the conveyor belts 27*a*–27*c* may be controlled by the associated photocells 28*a*, 28*b* which are connected with a non-illustrated drive motor that operates the belts 27*a*–27*c*. Underneath the hoppers 20–23 there is arranged a common conveyor belt (mixer belt) 29 which advances the fiber tufts deposited thereon towards a feeding device 30*a*, 30*b*. In the zone of the lower end of each hopper 20–23 there are arranged two delivery rolls 31*a*, 31*b* and an opening roll 32. The fiber layers are designated at I–IV and the arrow D indicates the direction of advance of the layers I–IV.

The fiber tufts are introduced into the fill chutes 20–23 in the direction of the arrow B approximately to the height of the photocells 28*a*, 28*b*. As soon as the fill height has fallen under the respective photocell 28*b*, refilling from above resumes. All four fill chutes 20–23 continuously and simultaneously discharge fiber material onto the belt 29. At the outlet of the mixer 5, above the conveyor belt 29, approximately in the zone below the housing wall 5*c*, there is arranged a roll 34 which presses down on the four-layer fiber tuft mass against the conveyor belt 29. The roll 34 is sealed against the lower edge of the wall 5*c* by an elastic seal 35 made of rubber or similar material. The fiber material leaving the mixer 5 is introduced by the driven conveyor belt 29 to the needle machine 7 which has cooperating feed rolls 30*a*, 30*b*. The driven conveyor belt 29 changes direction downstream of the outlet pressure roll 34, and is thus oriented towards the needle machine 7. Stated differently, the portion 29*d* of the conveyor belt 29 is situated externally of the outline of the mixer 5 and extends up to the feed rolls 30*a*, 30*b* of the needle machine 7 which is spaced from the mixer 5. Between the mixer 5 and the needle machine 7, above the conveyor belt portion 29*d* a conveyor belt 33 is arranged for guiding and compressing the four-layer fiber material.

Figure 4:
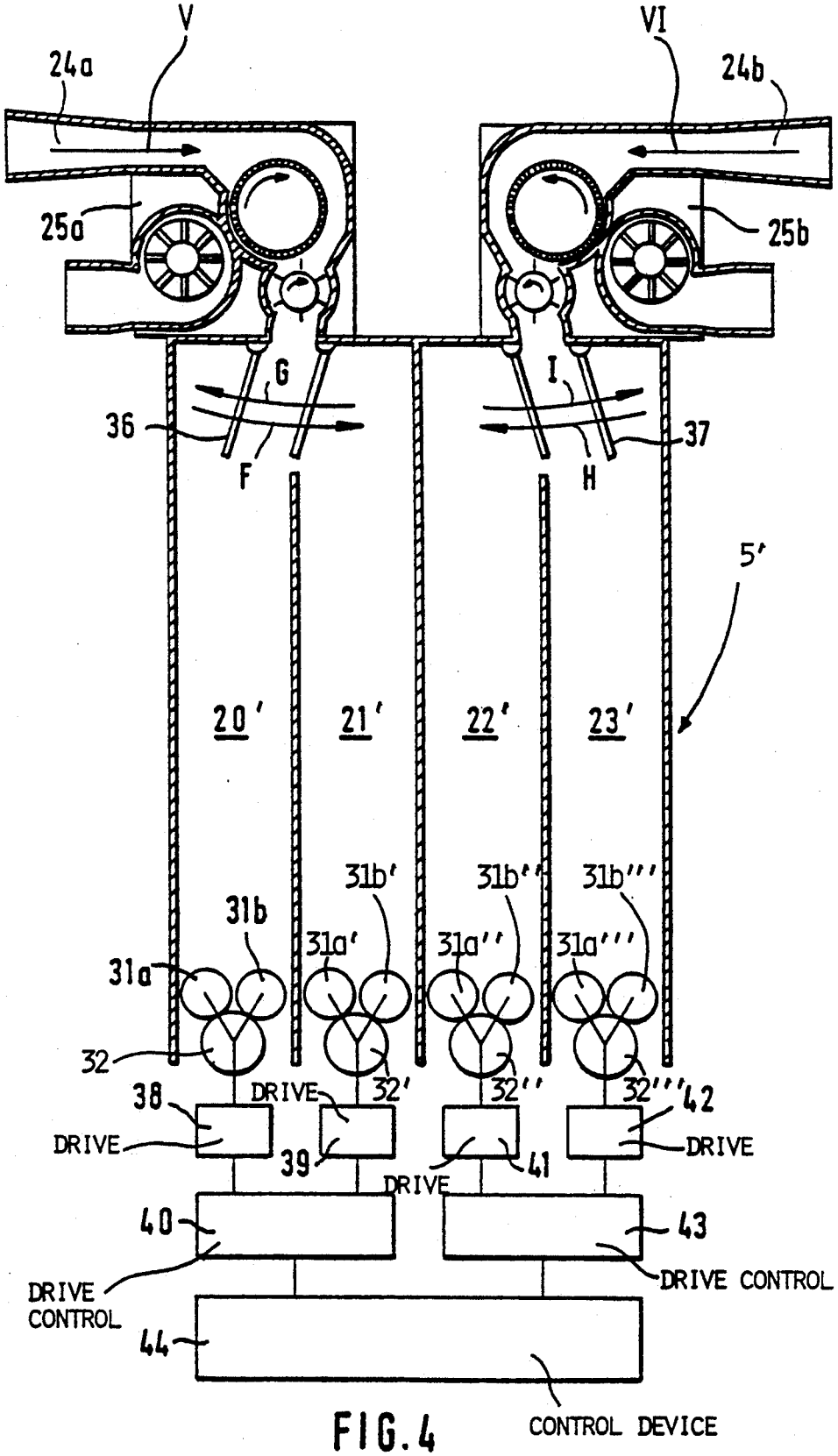
FIG. 4 is a schematic side elevational view, with block diagram, of a variant of a component machine shown in FIG. 3.

FIG. 4 shows a multimixer 5' having feed chutes (hoppers) 20', 21', 22' and 23'. Above the feed chutes 20', 21' there is arranged a condenser 25*a* with a screen drum and above the feed chutes 22', 23' there is arranged a condenser 25*b* with a screen drum. The condenser 25*a* is supplied with a fiber component V by a duct 24*a*, while the condenser 25*b* is supplied with a fiber component VI by a duct 24*b*. Between the condenser 25*a* and the fill chutes 20', 21' a distributing or routing gate assembly 36 is suspended which is pivotal as designated by the arrows F and G and which distributes the fiber material between the fill chutes 20', 21'. Between the condenser 25*b* and the fill chutes 22', 23', a gate assembly 37 is suspended which is pivotal in the direction as indicated by the arrows I, H and which distributes fiber material between the fill chutes 22' and 23'.

The driving device for the delivery rolls 31*a*, 31*b* situated at the bottom of the hopper 20' and the driving device 39 for the delivery rolls 31*a'*, 31*b'* situated at the bottom of the hopper 21' are connected to a common drive control 40 which controls the removal speed of the fiber component V from the fill chutes 20', 21'. The driving device 41 for the delivery rolls 31*a''*, 31*b''* arranged at the bottom of the hopper 22' and the driving device 42 for the delivery rolls 31*a'''*, 31*b'''* arranged at the bottom of the hopper 23' are connected to a common drive control 43 which controls the removal speed of the fiber material component VI withdrawn from the fill chutes 22', 23'. Underneath each delivery roller pair there is situated an opening roller 32, 32', 32'' and 32''', respectively. The drive controls 40 and 43 are, in turn, connected to a common control device 44 which is connected to the non-illustrated drive means for the fiber tuft conveying devices that introduce the components V and VI into the ducts 24*a* and 24*b*. The delivery rolls of each delivery roll pair may be interconnected by a drive gear or drive chain.

Figure 5:
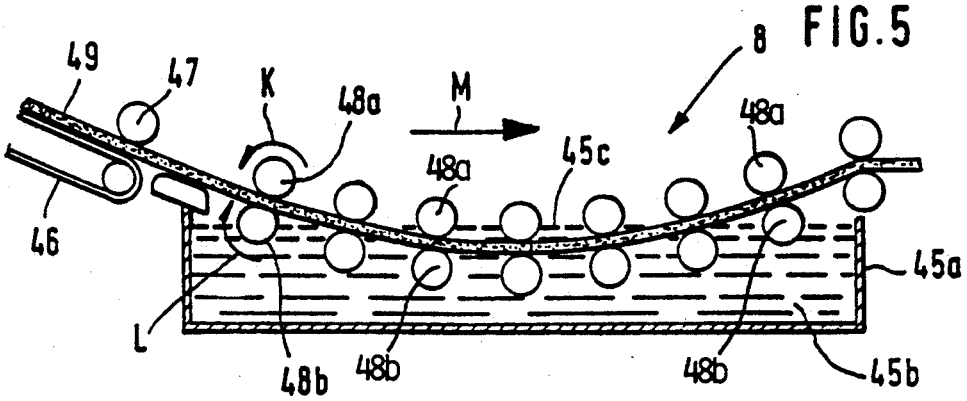
FIG. 5 is a schematic side elevational view of a further component machine of the embodiments according to FIGS. 1 or 2.

FIG. 5 shows a bleaching device 8 into which the fiber lap 49—which is the output product of the needle machine 7—is introduced from a conveyor belt 46, in cooperation with a pressure roll 47 which presses the fiber lap against the belt 46 at the discharge end thereof. The bleaching device 8 comprises a tub 45*a* which contains the bleaching liquid 45*b* having a level 45*c*. A plurality of guide roller pairs, each formed of two cooperating guide rollers 48*a*, 48*b*, are arranged in series along a curvilinear path which dips below the liquid level 45*c* to thus continuously guide the fiber lap 49 into and out of the bleaching liquid 45*b*. During the bleaching process impurities are entirely or at least partially removed or dissolved and at least partially bleached.

The bleached fiber lap 49 is introduced from the bleaching device 8 into a dryer 9 (FIG. 1) and is exposed therein, for example, to a warm air blast.

Figure 6:
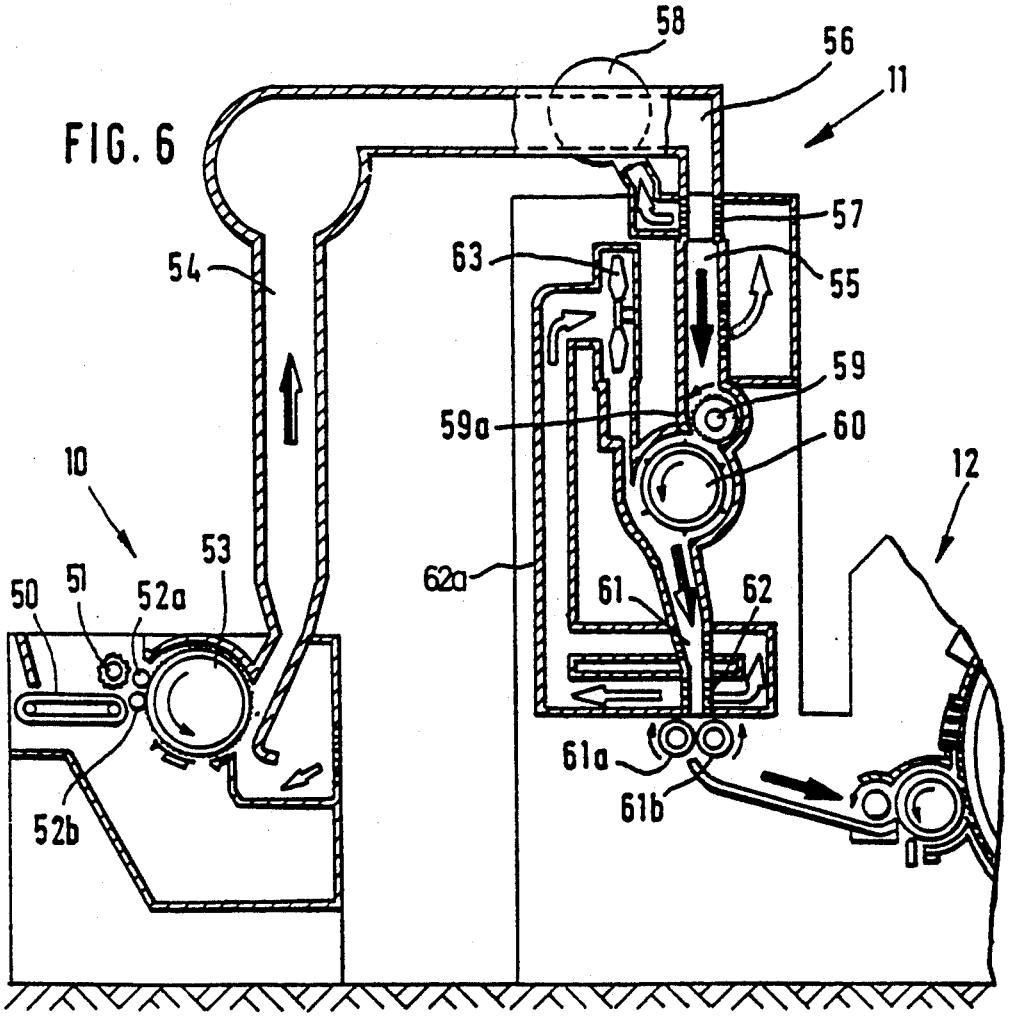
FIG. 6 is a schematic side elevational view of further components machines of the embodiments of FIGS. 1 or 2.

FIG. 6 illustrates a conveyor belt 50 which cooperates with a counter roll 51 for introducing the dried fiber lap 49 into the opener 10 which has two feed rolls 52*a*, 52*b* and a rapidly rotating sawtooth roll 53. In this apparatus the fiber lap 49 is broken into fiber tufts which are, through a pneumatic fiber tuft conveying duct 54, introduced into the fiber tuft feeder 11.

The tuft feeder 11 has a vertically oriented reserve chute 55 which is charged with finely opened fiber material from above by means of a supplying and distributing duct 56 extending from the opener 10. In the upper zone of the reserve chute 55 air outlet openings 57 are provided through which the transporting air stream, after separating from the fiber tufts, exits and enters into a suction device 58. The lower end of the reserve chute 55 is obturated by a feed roll 59 which cooperates with a wall surface 59*a* for advancing the fiber material to an opening roll 60 which, in turn, introduces the fiber material into a feed chute 61 of the feeder 11. The surface of the opening roll 60 is provided with pins or a sawtooth clothing. Both the feed roll 59 and the opening roll 60 rotate counterclockwise. The feed chute 61 has, at its lower end, two cooperating delivery rolls 61*a*, 61*b* which advance the fiber material to the rollercard unit 12.

The walls of the feed chute 61 are, in their lower portion, provided with air outlet openings 62 up to a certain height. The feed chute 61 communicates by means of a duct 62*a* with the low pressure side of a blower 63 which in turn forces the air stream past the opening roll 60 into the feed chute 61 for compressing the fiber tuft column forming therein. By virtue of the rotating feed roll 59 and the opening roll 60 a determined quantity of fiber material is introduced into the feed chute 61 and a similar quantity of fiber material is taken out of the feed chute 61 by the delivery roll pair 61*a*, 61*b* and advanced towards the rollercard unit 12.

The rollercard unit produces a fiber web which may be superposed to form several layers and is mechanically, thermally or in another manner stabilized to form a fiber lap in the web reinforcing device 13 (FIG. 1).

It will be understood that the above description of the present invention is susceptible to various modifications, changes and adaptations, and the same are intended to be comprehended within the meaning and range of equivalents of the appended claims.

What is claimed is:

1. An apparatus for making a fiber lap, comprising in combination (a) a fiber tuft mixer, including (1) a plurality of serially arranged, vertically oriented hoppers each having a top inlet and a bottom outlet;

(2) a charging device arranged for filling the hoppers with fiber tufts from above through the top inlet;

(3) delivering devices arranged for withdrawing fiber tufts from the bottom outlet of each hopper; and (4) a conveyor device extending underneath the hoppers and arranged to successively run past the outlets of the hoppers for successively receiving fiber tufts from the hoppers, whereby a multilayer fiber tuft mass is being continuously formed on the conveyor device;

(b) a needling machine for forming a stabilized fiber lap from the multilayer fiber tuft mass, said needling machine being arranged for receiving the multilayer fiber tuft mass from the conveyor device; and (c) a wet treatment device arranged for receiving the fiber lap from said needling machine.

2. An apparatus as defined in claim 1, wherein said wet treatment device includes a bleaching device.

3. An apparatus as defined in claim 1, wherein said wet treatment device includes a washing device.

4. An apparatus as defined in claim 1, further comprising control means connected to said delivering devices for regulating the fiber tuft output thereof relative to one another for setting a desired layer composition of the multilayer fiber tuft mass.

5. An apparatus as defined in claim 1, wherein said conveyor device comprises a driven conveyor belt.

6. An apparatus as defined in claim 1, further comprising a dryer arranged for receiving the fiber lap from said wet treatment device.

* * * * *